United States Patent [19]

Moll et al.

[11] 4,172,814

[45] Oct. 30, 1979

[54] EMULSION CATALYST FOR HYDROGENATION PROCESSES

[75] Inventors: Norman G. Moll, Sanford; George J. Quarderer, Midland, both of Mich.

[73] Assignee: The Dow Chemical Company, Midland, Mich.

[21] Appl. No.: 964,996

[22] Filed: Nov. 30, 1978

Related U.S. Application Data

[62] Division of Ser. No. 772,874, Feb. 28, 1977, Pat. No. 4,136,013.

[51] Int. Cl.[2] ..... C10G 13/06; B01J 27/04

[52] U.S. Cl. ..... 208/108; 208/215; 252/439; 252/467

[58] Field of Search ..... 208/108, 10, 112, 215; 252/439, 467, 477 R; 260/667

[56] References Cited

U.S. PATENT DOCUMENTS

| | | | |
|---|---|---|---|
| 2,987,465 | 6/1961 | Johanson | 208/10 |
| 3,321,393 | 5/1967 | Schuman et al. | 208/10 |
| 3,338,820 | 8/1967 | Wolk et al. | 208/108 |
| 3,532,617 | 10/1970 | Hodgson | 208/10 |
| 3,745,108 | 7/1973 | Schuman et al. | 208/10 |
| 4,090,943 | 5/1978 | Moll et al. | 208/10 |
| 4,125,455 | 11/1978 | Herbstman | 208/108 |
| 4,134,825 | 1/1979 | Bearden et al. | 208/108 |

*Primary Examiner*—Delbert E. Gantz
*Assistant Examiner*—G. E. Schmitkons
*Attorney, Agent, or Firm*—G. R. Plotecher

[57] ABSTRACT

In the catalytic hydrogenation of a substance in a water-immiscible organic liquid medium, a metallic hydrogenation catalyst is conveniently and effectively dispersed in the reaction mixture by addition as an emulsion of an aqueous solution of a salt of the metal in the liquid medium. The method is particularly applicable to the liquefaction of coal.

11 Claims, No Drawings

EMULSION CATALYST FOR HYDROGENATION PROCESSES

CROSS REFERENCE TO RELATED APPLICATION

This is a division of application Ser. No. 772,874 filed Feb. 28, 1977, now U.S. Pat. No. 4,136,013.

BACKGROUND OF THE INVENTION

The present invention relates to an improved method whereby a hydrogenation catalyst is conveniently and effectively dispersed in and contacted with a reaction mixture. It relates particularly to an improved method for dispersing such catalysts in heavy petroleum fractions and in liquid hydrocarbon slurries of coal prior to hydrogenation.

The hydrogenation of finely divided coal, residual oil, or other such heavy hydrocarbonaceous substances to mixtures of gaseous and liquid products has been studied for many years. In recent years, the liquefaction of coal in particular has become of more urgent interest because of dwindling petroleum resources. Although coal can be successfully hydrogenated to produce both gaseous and liquid products without the addition of a hydrogenation catalyst, since traces of catalytically active metals are normally present in coal, better yields of the desired products are obtained under more moderate reaction conditions when a metal hydrogenation catalyst is used.

Active catalysts for these processes constitute a known class including the metals or compounds of the metals iron, nickel, cobalt, molybdenum, tungsten, tin, zinc, vanadium, chromium, antimony, and a number of others, alone or in combination. Active metals such as palladium, platinum, and rhenium are also effective but are too expensive for the purpose. These hydrogenation catalysts can be added to the hydrogenation mixture as the finely divided metals or as compounds thereof, either supported or unsupported. In the hydrogenation of coal and heavy petroleum fractions, the predominant stable form for most of these metal catalysts is the sulfide which can be formed during the hydrogenation process from the sulfur naturally present in these fossil hydrocarbonaceous substances or by presulfiding the catalyst.

Two well researched processes use a bed of particulate catalyst, usually a nickel or cobalt molybdate supported on alumina, through which are pumped a mixture of hydrogen and a dispersion of finely divided coal in a liquid hydrocarbon medium or a heavy hydrocarbon fraction at elevated temperature and pressure. The Synthoil process, developed at the U.S. Bureau of Mines for the hydrogenation of coal, employs a stationary bed of pelleted or granular catalyst. The process is outlined by Yavorsky et al. in Chem. Eng. Progess 69(3), 51-2 (1973). The "ebullated bed" or H-Coal process employs a bed of similar but more finely divided catalyst which is maintained in the reactor in a turbulent or boiling state as the reaction mixture is passed through it, thereby maximizing contact with the catalyst particles. This process has been used both for the hydrogenation of coal and the hydrogenation of residual oil. The process and variations of it are described in a series of patents of which Johanson, U.S. Pat. No. Re 25,770 (of U.S. Pat. No. 2,987,465); Schuman et al., U.S. Pat. No. 3,321,393; and Wolk et al., U.S. Pat. No. 3,338,820 are representative, see also Oil & Gas J. 74 (35) 52-3 (1976).

Both of the above processes are effective for the purpose but have inherent difficulties or disadvantages associated with the use of a bed of catalyst, that is, the necessity for specially designed apparatus, the need to avoid occlusion of the catalyst by feed material, the need to avoid caking or plugging in process equipment by particles of catalyst, the deactivation of the catalyst by components of the feed material, and the problems of loading fresh catalyst in the reactor and the removal of spent catalyst. Loss of catalyst fines in the product oil is another problem in this process.

Other known coal and residual oil hydrogenation processes have added a catalyst directly to the reaction mixture as the finely divided metal or a metal compound, either of which may be converted to a catalytically active form under reaction conditions. Some processes have used the metal hydrogenation catalyst in the form of a water-soluble salt, with or without added water. Schuman, U.S. Pat. No. 3,745,108 employs a liquid medium for a coal slurry which is part or all water containing a salt of the metal catalyst in solution, ammonium heptamolybdate ($(NH_4)_6Mo_7O_{24}.4H_2O$) being exemplified. This latter process is effective, but the maintenance of a liquid aqueous phase in the process imposes certain limitations on the process conditions and apparatus. Thus, the process temperature is necessarily rather low with resultant comparatively low conversion of coal and low yield of liquid hydrocarbons. In coal hydrogenation, more effective use of the catalyst has been obtained in some cases by prior impregnation of the coal with a catalyst compound, see Pelipetz, U.S. Pat. No. 2,860,101, and Schuman, cited above, for example.

SUMMARY OF THE INVENTION

It has now been found that in the process for hydrogenating a hydrogenatable organic substrate by contacting that substrate as a water-immiscible liquid phase with hydrogen in the presence of a metal-containing hydrogenation catalyst, the catalyst is conveniently introduced into and efficiently dispersed in the liquid phase by initially adding it as an emulsion of a water solution of a compound of the metal in the said liquid phase, the metal compound being convertible to the active hydrogenation catalyst under the conditions of hydrogenation. The active catalyst is thereby formed in situ as microscopically fine particles uniformly dispersed in the liquid reaction mixture.

The method of catalyst addition and dispersion is particularly applicable in the hydrogenation of a dispersion of coal in a liquid hydrocarbon medium and in the similar hydrogenation of a heavy petroleum fraction. Under the conditions of this hydrogenation process, there is no longer a separate aqueous phase and the dissolved metal compound is decomposed and converted to an active form of the metal catalyst, probably a sulfide.

Thus the invention is essentially an improved method whereby a catalyst is more conveniently and efficiently dispersed and utilized so that a very small quantity can provide optimum results.

DETAILED DESCRIPTION OF THE INVENTION

The present method for catalyst addition and dispersion in the reaction mixture is particularly advantageous in the hydrogenation of a heavy hydrocarbonaceous substance such as coal, residual oil, and tar or pitch, either of natural origin or derived from petroleum or coal, to obtain more useful lower boiling products, gaseous or liquid although largely liquid products are usually more desirable. The conditions for hydrogenation of these substances are well-known. Process pressures may range from about 1000 psi to as high as 10,000 psi but are usually in the range from about 1500 to about 3000 psi. Process temperatures can be as low as 300° C. to as high as 600° C., but a range of about 400° C. to about 500° C. is more commonly used, depending upon the particular catalyst, the type of substance being hydrogenated, and the kind of product desired, i.e., larger or smaller proportions of gaseous hydrocarbons, lower boiling liquids, or relatively higher boiling liquid hydrocarbons.

This new method is of special interest in the liquefaction of coal, more particularly, coal crushed and dispersed in a liquid hydrocarbon medium to provide a pumpable slurry.

The quantity of catalyst used in this improved process can be significantly less than the quantities preferred in somewhat similar prior art processes because of the better dispersion thereby provided throughout the reaction mixture. For molybdenum in the form of ammonium or alkali metal heptamolybdate, proportions of about 0.01–1 percent molybdenum based on coal or other substance being hydrogenated give good results and about 0.02–0.5 percent molybdenum is preferred whereas comparable prior art processes commonly employ much more catalyst. Similar low proportions of other coal and residual oil hydrogenation catalysts are also effective in the improved process. Less active catalysts such as iron may require somewhat higher proportions, up to about 1 percent, for example. The proportion of catalyst in the reaction mixture is a variable which affects the product distribution and degree of conversion. Normally, relatively high proportions of catalyst result in higher conversion but also higher yields of gases and light oil which may be undesirable. The smaller proportions of catalyst made possible by this invention with better catalyst dispersion can provide both high conversion and high yields of higher boiling oil. The convenient mode of catalyst addition and the broad applicability of the method are other principal advantages of the invention.

The proportions of metal compound to water and of water solution to emulsifying oil have a significant effect on the characteristics of the catalyst. Good results are obtained when a concentrated aqueous solution is emulsified but generally a somewhat more active catalyst is formed when a relatively dilute solution is used, probably because smaller particles of catalyst are produced. It is also desirable to maintain a high proportion of emulsifying oil to water solution in order to make a relatively stable emulsion of small aqueous droplets and consequently a finely dispersed catalyst.

Since a liquid feed mixture is ordinarily passed to the hydrogenation process soon after being made up with the emulsified catalyst solution, the emulsion does not have to be of very high stability and the use of an emulsifier or emulsion stabilizer may not be necessary. In some systems, however, such an additive may be of advantage in facilitating the formation of an emulsion or in obtaining very small aqueous droplets in the emulsion. Any convenient method can be used to emulsify the salt solution in the hydrocarbon medium. To obtain the optimum fine dispersion of catalyst throughout the reaction mixture, it is important that the droplet size of aqueous phase in the emulsion be very small. This condition can be achieved by initially forming a dispersion of oil in the aqueous solution, then causing the dispersion to reverse by slowly adding more oil so that the oil becomes the continuous phase and the aqueous solution is very finely dispersed in it. Other methods of forming the emulsion have given satisfactory results, however.

In some coal and residual oil hydrogenation processes, a separate sulfiding step is used to make the metal catalyst more active. In the present improved process, the smaller quantities of catalyst are effectively sulfided and activated during operation by the small amounts of sulfur normally present in coal and petroleum. No specific catalyst sulfiding step is needed, therefore.

The liquid hydrocarbon medium in which the powdered coal is slurried or a residual oil or tar is dispersed (when such a diluent is desirable) can be any convenient petroleum fraction or similar liquid, but preferably it is the liquid hydrocarbon obtained from the hydrogenation process or recycle oil fraction as used in most prior art hydrogenation processes. For best results, such recycle oil has been treated to remove at least some of the low boilers and insoluble components. In coal liquefaction, the proportion of oil to coal in the process slurry is also generally as shown in the art, that is, sufficient to provide a pumpable mixture. Proportions of 55–75 parts by weight of oil to 45–25 parts of coal are typical. For the hydrogenation of residual oil, tar, or pitch, somewhat lower proportions of the liquid hydrocarbon medium or none at all may be preferred.

The water-soluble salt of the catalytic metal can be essentially any such salt. For metal catalysts such as those of the iron group, tin, or zinc, the nitrate or acetate may be most convenient whereas for molybdenum, tungsten, or vanadium, more complex salts, such as an alkali metal or ammonium molybdate, tungstate, or vanadate may be preferable. Mixtures of two or more metal salts can be used.

A particular advantage of the present process is the fact that it may not be necessary to include a catalyst recovery step as in many prior art processes because of the very small amounts of catalyst that are used.

Other advantages derived from the small amounts of catalyst used in this process and the high dispersion of catalyst that is achieved are simpler reactor design because there is no need for high internal circulation rates and the elimination of costly shutdowns for removal of catalyst deposits in process equipment.

Analytical Procedures

In the working examples described below, the analytical procedures employed were as follows:

Viscosity

Viscosities of oil samples were measured at 25° C. using a Brookfield viscometer. Ash was not removed from the oil prior to the measurement.

Toluene Insolubles and Ash

A 40 g sample was shaken with 160 g of toluene and centrifuged. The supernatant liquid was decanted and the remaining residue of toluene-insoluble hydrocarbons and ash was vacuum dried at 100° C. and weighed. The ash content of the residue was determined by standard procedures.

Asphaltenes

A 25 g sample was shaken with 100 g of n-hexane and centrifuged. The supernantant liquid was decanted and the residue, a mixture of ash, toluene insolubles, and toluene soluble hydrocarbons which are insoluble in n-hexane (asphaltenes), was vacuum dried at 100° C. and weighed. The asphaltene content was determined by substracting toluene insolubles and ash from the total hexane insolubles.

Coal Analysis

The coal used in the examples was Pittsburgh No. 8 Allison Mine bituminous coal crushed, dried, and pulverized to pass a 120 mesh screen. The sulfur content was about 3.9 percent.

EXAMPLE 1

In a 55-gallon makeup tank, 73 pounds of bituminous coal, pulverized and dried with a mean particle size of less than 75 microns, was stirred with 109.5 pounds of recycle oil from the coal hydrogenation process until a smooth slurry was obtained. To this slurry was added an emulsified catalyst solution prepared as follows: 36.5 g of ammonium heptamolybdate tetrahydrate, $(NH_4)_6Mo_7O_{24}0.4H_2O$, was dissolved in 109.5 g of water at room temperature. An emulsion of this solution in oil was prepared by slowly adding 350 g of filtered recycle oil to the solution while mixing with an Eppenbach Homo-Mixer over a period of about 5 minutes. The catalyst emulsion was then added to the slurry of coal in oil and the whole was stirred for about one hour.

The coal-oil slurry was fed by a high pressure pump to a point where hydrogen was mixed with it and the mixture was fed at 13.6 pounds slurry and 0.265 pound mole $H_2$ per hour under 2,000 psi pressure through a preheater and a 0.286 cu ft capacity elongated tubular reactor maintained at 460° C. The effluent from the reactor was let down to atmospheric pressure and then separated by conventional means into gas, light oil boiling below 150° C., a small amount of aqueous phase, and oil boiling above 150° C. plus residue. Product distribution based on the slurry feed was as follows:

TABLE I

| | wt. % |
|---|---|
| gases | 7.7 |
| light oil | 2.5 |
| aqueous phase | 1.9 |
| 150+° C. oil + residue | 87.9 |
| | 100.0 |

Hydrogen conversion was better than 50 percent and total product recovery was greater than 98 percent based on the slurry feed.

EXAMPLE 2

Using the apparatus and general procedure described in Example 1, a two-stage experiment was carried out to demonstrate the effect of the emulsified catalyst system in a coal hydrogenation process. In the first stage which was of 28.75 hours duration, a 40 percent coal-60 percent recycle oil slurry with no added catalyst was pumped through the reactor with average rates of 21.4 pounds slurry and 0.35 pound mole hydrogen per hour at reactor pressure and temperature levels of Example 1. The recycle oil containing 70 ppm Mo (equivalent to 0.01 percent Mo based on the coal) remaining from previous operation. At the end of the first stage, an emulsion of aqueous ammonium molybdate in oil was added to the slurry feed to provide a Mo level of 0.12 percent based on the coal. This slurry mixture was run through the reactor as before for 8.75 hours. Samples of effluent were taken for analysis at several points during the two stages of the run and larger quantities of effluent were collected for material balance determinations, two in the first stage and one in the second.

The recycle oil was 150+° C. product with the following analysis:

TABLE II

| | |
|---|---|
| Viscosity | 93 cps |
| Ash content | 0.074% |
| Asphaltenes | 29.65% |
| Mo content | 70 ppm |

The coal used in this run had an average ash content of 11.7 percent.

TABLE III

| | Analytical Samples | | | | |
|---|---|---|---|---|---|
| | No Mo Added | | | Mo Added | |
| Time, min. | 368 | 1,046 | 1,675 | 2,040 | 2,220 |
| Viscosity, cps | 1,105 | 367 | 515 | 80 | 78 |
| Asphaltenes in 150+° C. oil | 32.68 | — | 30.40 | 24.42 | 23.78 |
| ppm Mo in 150+° C. oil | — | — | 8 | — | 840 |

TABLE IV

| | | Material Balance Samples | | |
|---|---|---|---|---|
| | | No Mo Added | | Mo Added |
| Time, min. | | 855 | 1186 | 1860 |
| Pressure, psi | | 2307 | 2000 | 2000 |
| Slurry feed, lb/hr | | 21.9 | 21.0 | 21.4 |
| $H_2$ feed, SCF/hr | | 134.9 | 124.4 | 153.2 |
| Effluent Weight % | Gas | 7.8 | 7.9 | 9.1 |
| | Light Oil | 3.1 | 3.7 | 4.4 |
| | Aqueous phase | 2.7 | 3.1 | 3.3 |
| | 150+° C. oil | 86.3 | 85.3 | 83.3 |
| % Recovery on slurry | | 98.8 | 101.6 | 98.8 |
| lb $H_2$ conv/100 lb coal | | 3.77 | 3.38 | 4.98 |
| % Mo in slurry (based on coal) | | 0.01 | 0.01 | 0.12 |
| % Conversion* of coal (moisture and ash-free basis) to toluene-soluble material | | 66.9 | 66.2 | 83.2 |

*Percent conversion of coal was calculated according to the following formula:

$$\% \text{ Conversion} = 100\left(1 - \frac{z(1+s.h)(1-y_3)x_3}{s(1-y_2) + (1-s)x_1(1-y_1)}\right)$$

where s = weight fraction of coal in the slurry
$x_1$ = fraction of toluene insolubles in slurry oil
$y_1$ = fraction of ash in $x_1$
$y_2$ = fraction of ash in coal
$y_3$ = fraction of ash in toluene insolubles from 150+° C. oil
$x_3$ = fraction of toluene insolubles in 150+° C. oil
h = lb $H_2$ consumed per lb coal
z = fraction of product as 150+° C. oil.

EXAMPLES 3–7

Using the apparatus and general procedure described in Example 1, 60-40 oil-coal slurries containing different metal salt solutions emulsified in the oil were pumped through the reactor at 460° C. and 2,000 psi. In Examples 3 and 4, the catalyst salts were respectively 0.11 percent (based on coal) of a mixture of $Co(NO_3)_2.6H_2O$ and ammonium heptamolybdate tetrahydrate and 0.11 percent of a similar mixture of $Ni(NO_3)_2.6H_2O$ and ammonium heptamolybdate tetrahydrate, in each of which mixtures the metals were present in an equal atomic ratio. In Example 5, the catalyst salt was 0.5 percent of $FeSO_4.7H_2O$, in Example 6, the catalyst salt was 0.1 percent of $Na_2WO_4.2H_2O$, and in Example 7, the catalyst salt was 0.11 percent of ammonium heptamolybdate tetrahydrate as in Example 1. Samples of effluent were analyzed as before after several hours of operation in each case. The conditions and results found are listed in Table V.

TABLE V

| Example No. | 3 | 4 | 5 | 6 | 7 |
|---|---|---|---|---|---|
| Catalyst | Co/Mo | Ni/Mo | Fe | W | Mo |
| Slurry rate, lb/hr | 12.15 | 13.62 | 19.82 | 19.51 | 17.86 |
| $H_2$ rate, SCF/hr | 103.7 | 103.9 | 128.3 | 140.3 | 147.2 |
| % $H_2$ consumed | 54.2 | 54.5 | 62.7 | 46.6 | 54.1 |
| Effluent | | | | | |
| % Gas | 8.4 | 8.3 | 9.9 | 9.3 | 6.9 |
| % Light oil | 4.0 | 2.6 | 3.2 | 2.9 | 2.8 |
| % Aq. phase | 2.8 | 2.4 | 2.3 | 2.4 | 2.2 |
| % 150+° C. oil & residue | 84.8 | 86.7 | 84.5 | 85.4 | 88.1 |
| % Recovery based on the slurry feed | 99.7 | 98.4 | 102.0 | 101.1 | 99.9 |

EXAMPLE 8

As described in the foregoing examples, a 60-40 recycle oil-coal slurry was pumped through the reactor at a constant rate of 20 lb/hr with 0.36 pound mole per hour of hydrogen at a reactor pressure of 2000 psig. The coal slurry feed contained ammonium heptamolybdate solution emulsified in the oil at a concentration of 0.027 percent molybdenum based on the coal. During this run, the reactor temperature controller was set at 475° C. As can be seen from the data in Table VI, the proportions of gas, light oil, water, and toluene insolubles are higher at higher temperatures while the asphaltene content and viscosity of the 150+° C. oil fraction are lower.

TABLE VI

| | |
|---|---|
| Temperature, °C. | 475 |
| Mat'l Balance, wt. % | 99.1 |
| Lb $H_2$ converted per 100 lb coal | 4.4 |
| Product, wt. % | |
| 150+° C. oil | 78.2 |
| light oil | 5.2 |
| gas | 13.4 |
| aqueous phase | 3.4 |
| Composition of 150+° C. oil, wt. % | |
| ash | 5.3 |
| toluene insoluble | 13.4 |
| asphaltenes | 24.9 |
| hexane soluble | 56.4 |
| Viscosity of 150+° C. oil, cps | 173 |

EXAMPLES 9-10

Coal slurries were hydrogenated as described in Example 1 using 0.1 percent ammonium heptamolybdate tetrahydrate as the catalyst. In Example 9, the molybdate salt was dissolved in three times its weight of water as in Example 1 and in Example 10, the salt was dissolved in fifteen times its weight of water. The effects of using these solutions of different concentration emulsified in the starting slurry are shown in the listed results.

TABLE VII

| Exmaple No. | 9 | 10 |
|---|---|---|
| Water/Salt ratio | 3:1 | 15:1 |
| Slurry rate lb/hr | 14.67 | 14.84 |
| $H_2$ rate SCF/hr | 144.2 | 132.0 |
| lb $H_2$ consumed per 100 lb coal | 6.5±0.5 | 5.7±0.5 |
| Effluent | | |
| % Gas | 8.7 | 9.5 |
| % Light oil | 2.3 | 3.6 |
| % Aqueous phase | 2.2 | 3.3 |
| % 150+° C. oil | 86.7 | 83.4 |
| % Recovery based on slurry feed | 100.3 | 100.3 |

Analysis of the oil fractions boiling above 150° C. showed lower viscosity (117.5 cps vs. 234 cps) for the product of Example 10 where the more dilute molybdate solution was emulsified in the starting coal slurry. The products of Example 10 also showed somewhat higher proportions of gas and light oil. These results indicate a slightly higher activity for the molybdenum catalyst in that example. Small differences in the slurry makeup oil used in these two examples (132 cps viscosity and 28.0 percent asphaltenes for that in Example 9 as against 123 cps viscosity and 23.4 percent asphaltenes in the Example 10 makeup oil) probably had no substantial effect on these results.

In a manner similar to that shown in the above examples, a solution or dispersion of residual oil, tar, or pitch in a hydrocarbon oil containing an emulsified water solution of a metallic catalyst salt is hydrogenated to obtain lower boiling hydrocarbon products. Where the viscosity of the residual oil or other such fraction is sufficiently low, no lighter oil need be added as a diluent, of course, the oil fraction then constituting its own liquid medium. As previously shown, the proportion of gas and lower boiling liquid hydrocarbons in the product is favored by higher temperatures, longer residence time, and also to some extent by higher proportions of catalyst.

As previously noted, the process described herein for the addition and dispersion of a hydrogenation catalyst as an emulsion of an aqueous metal compound solution in a water-immiscible liquid reaction mixture is similarly applicable to other such hydrogenation processes. Examples of such processes include the hydrogenations of benzene and naphthalene to cycloparaffins and vegetable or animal oils to saturated fats.

We claim:

1. In the process for hydrogenating a hydrogenatable organic substrate other than coal by contacting said substrate as a water-immiscible liquid phase with hydrogen in the presence of a metal-containing hydrogenation catalyst, the improvement wherein said metal-containing catalyst is initially added to the water-immiscible liquid phase as an emulsion of a water solution of a compound of said metal in said liquid phase, said compound being convertible to the hydrogenation catalyst under the conditions of hydrogenation.

2. The process of claim 1 wherein a hydrocarbonaceous substance is hydrogenated to lower boiling products by contacting a dispersion of said substance in a liquid hydrocarbon medium with hydrogen at elevated temperature and pressure.

3. The process of claim 2 wherein the hydrogenation temperature is about 400° C.-500° C.

4. The process of claim 2 wherein the metal is molybdenum.

5. The process of claim 4 wherein the molybdenum compound is ammonium heptamolybdate.

6. The process of claim 4 wherein 0.01–1 percent of molybdenum is present in the slurry based on the weight of substrate.

7. The process of claim 6 wherein 0.02–0.5 percent of molybdenum is present.

8. The process of claim 2 wherein the metal is a mixture of cobalt and molybdenum.

9. The process of claim 2 wherein the metal is a mixture of nickel and molybdenum.

10. The process of claim 2 wherein the metal is iron.

11. The process of claim 2 wherein the metal is tungsten.

* * * * *